US008833463B2

(12) United States Patent
Graves

(10) Patent No.: US 8,833,463 B2
(45) Date of Patent: Sep. 16, 2014

(54) ABOVE MUDLINE WHIPSTOCK FOR MARINE PLATFORM DRILLING OPERATIONS

(75) Inventor: Kyle S. Graves, Perth (AU)

(73) Assignee: Apache Corporation, Houston, TX (US)

( * ) Notice: Subject to any disclaimer, the term of this patent is extended or adjusted under 35 U.S.C. 154(b) by 276 days.

(21) Appl. No.: 13/177,586

(22) Filed: Jul. 7, 2011

(65) Prior Publication Data

US 2013/0008664 A1 Jan. 10, 2013

(51) Int. Cl.

| | |
|---|---|
| ***E21B 7/12*** | (2006.01) |
| ***E21B 7/128*** | (2006.01) |
| ***E21B 7/04*** | (2006.01) |
| ***E21B 7/06*** | (2006.01) |

(52) U.S. Cl.

CPC ..... *E21B 7/043* (2013.01); *E21B 7/061* (2013.01)

USPC ..... 166/358; 166/361; 166/366; 166/255.3; 175/7

(58) Field of Classification Search

CPC ..... E21B 7/12; E21B 7/128

USPC ..... 166/366, 358, 255.3, 117.5; 175/5–10

See application file for complete search history.

(56) References Cited

U.S. PATENT DOCUMENTS

| | | | | |
|---|---|---|---|---|
| 3,899,032 | A * | 8/1975 | Rees et al. | 175/9 |
| 4,687,062 | A * | 8/1987 | Beghetto et al. | 166/366 |
| 4,733,732 | A * | 3/1988 | Lynch | 175/9 |
| 5,002,432 | A * | 3/1991 | Dysarz | 405/195.1 |
| 6,247,541 | B1 * | 6/2001 | Ellis et al. | 175/9 |
| 7,484,575 | B2 * | 2/2009 | Angelle et al. | 175/67 |
| 8,230,920 | B2 * | 7/2012 | Bell | 166/255.3 |
| 2006/0260809 | A1 * | 11/2006 | Crain | 166/277 |

* cited by examiner

*Primary Examiner* — James Sayre
(74) *Attorney, Agent, or Firm* — Richard A. Fagin

(57) ABSTRACT

A whipstock system for drilling a wellbore from a water bottom supported platform having wellbores with conductor pipes disposed through guide slots in a template on the bottom of a body of water includes a whipstock pipe extending from an equipment deck surface on the platform to a stab in sub. The whipstock pipe includes a window and j-slot mechanism for releasably engaging a scab liner. A stab in sub is configured to make mechanical connection between the whipstock pipe and a surface of a wellbore conductor pipe cut proximate the water bottom. The system includes a scab liner extending from the window to the water bottom when the stab in sub is engaged to the cut conductor pipe. The window is disposed above the water bottom. The scab liner configured to enable drilling a wellbore surface hole therethrough to a selected depth of a surface casing.

7 Claims, 3 Drawing Sheets

ABOVE MUDLINE WHIPSTOCK FOR MARINE PLATFORM DRILLING OPERATIONS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

The invention relates generally to the field of marine wellbore drilling from multiple wellbore, water bottom supported platforms. More specifically, the invention relates to devices for re-using conductor pipe in depleted wellbores drilled from such platforms so that additional wellbores may be drilled from the same platform, wherein the platform has a limited number of "slots" for location of pipe in the upper portion of such wellbores.

Wellbores are drilled from bottom supported platforms in bodies of water such as lakes or the sea for, among other purposes, extracting hydrocarbons from formations below the bottom of the body of water. Such platforms typically includes "slots" in one of more horizontally disposed frame like structures for the location of the portion of the wellbore that extends from the water bottom to a part of the platform above the water surface. The wellbores are typically drilled with selected trajectories to access selected formations at subsurface geodetic locations displaced from the geodetic location of the platform.

When all platform slots are full, that is, when wellbores are drilled such that the upper portions thereof fill all the slots, it is generally necessary to wait for one or more of the wellbores to no longer be usable (e.g., when production of hydrocarbons stops or no longer takes place at an economically useful rate), at which point such wellbore(s) may be plugged and abandoned. The associated slot(s) may then be used to drill "infill" wellbore(s). Such wellbores typically have trajectories selected to access additional hydrocarbon bearing formations or previously unproduced portions of such formations penetrated by other wellbores at different depths and/or geodetic locations. Such procedure enables reuse of slots repeatedly.

The manner in which the reuse of slots is performed depends on many factors, e.g., water depth, the number of conductor pipe guides on the platform and the distance between them, the ability of platform to withstand new additional loads later in its life (i.e., fatigue strength), and how the reclaimed well was originally constructed.

As an example, the assignee of the present invention operates a platform in 49 meters depth of water with one platform guide located 8.8 meters below sea level and having 12 slots. The wellbores on this platform typically have short producing lifetimes and the well slots are frequently recycled/reclaimed for new "infill" wells. The wells on the foregoing described platform have been constructed in a variety of ways during its operating lifetime, but wellbores with mud line suspension systems, and wellbores that were predrilled and then tied back after the platform was installed present the most difficult mechanical problems during the slot reclamation process.

It has been the practice of the assignee of the present invention to reclaim the slots up to the base of the structural conductor pipe of the wellbore in each reclaimed slot, enabling reuse of the conductor pipe and enabling redrilling wellbores from the depth of the conductor pipe (typically about 50 meters below the water bottom). There have been numerous problems with the foregoing type of slot reclamation, ranging from complications during cleaning out the wellbore's mud line suspension systems and tieback systems (the foregoing devices are located just below the water bottom or "mud line") thus making it difficult to successfully drill replacement (infill) wells along different selected trajectories to establish the new infill wells. A typical problem in drilling infill wells from slots reclaimed in such manner is exposure to formations that are known to have low fluid pressures, thus resulting in fluid loss during drilling.

The assignee of the present invention has built and used "mud line" (water bottom) whipstocks that are set on cut casing strings, but these are typically set on wells where there is no seabed template. Such whipstocks are typically 20 inches diameter and are located below the conductor pipe, again with the intention of reusing the conductor pipe in a reclaimed wellbore. Such whipstocks have been primarily designed to manage the difficulties associated with achieving successful cement side-track plugs in loss situations.

Dealing with the issue of working around a large seabed template has also been evaluated. Some companies provide a type of "ramp" of that sits in the cut casing string. Then a new conductor string is run and is deflected over and around the seabed template via the ramp. This concept is typically associated with conductors that are driven into the water bottom sediments. It is desirable to drill a conductor pipe hole prior to running the conductor pipe due to the nature of the sediments in place.

SUMMARY OF THE INVENTION

A method according to one aspect of the invention for drilling a wellbore from a water bottom supported platform having wellbores with conductor pipes disposed through guide slots in a template on the bottom of a body of water includes abandoning a selected wellbore and reclaiming all equipment to the top of the wellbore conductor pipe. The conductor pipe is cut proximate the water bottom. A whipstock system is inserted into the cut conductor pipe. The whipstock system includes a whipstock pipe configured to engage the top of the cut conductor pipe, a window therein disposed above the water bottom and a scab liner engaged to the whipstock pipe at the position of a window in the whipstock pipe, the scab liner extending from the window to the water bottom. A wellbore is drilled to a selected depth through the scab liner.

A whipstock system according to another aspect of the invention for drilling a wellbore from a water bottom supported platform having wellbores with conductor pipes disposed through guide slots in a template on the bottom of a body of water includes a whipstock pipe extending from an equipment deck surface on the platform to a stab in sub. The whipstock pipe includes a window and j-slot mechanism for releasably engaging a scab liner. A stab in sub is configured to make mechanical connection between the whipstock pipe and a surface of a wellbore conductor pipe cut proximate the water bottom. The system includes a scab liner extending from the window to the water bottom when the stab in sub is engaged to the cut conductor pipe. The scab liner configured to enable drilling a wellbore surface hole therethrough to a selected depth of a surface casing.

Other aspects and advantages of the invention will be apparent from the description and claims which follow.

DETAILED DESCRIPTION

Figure 1:
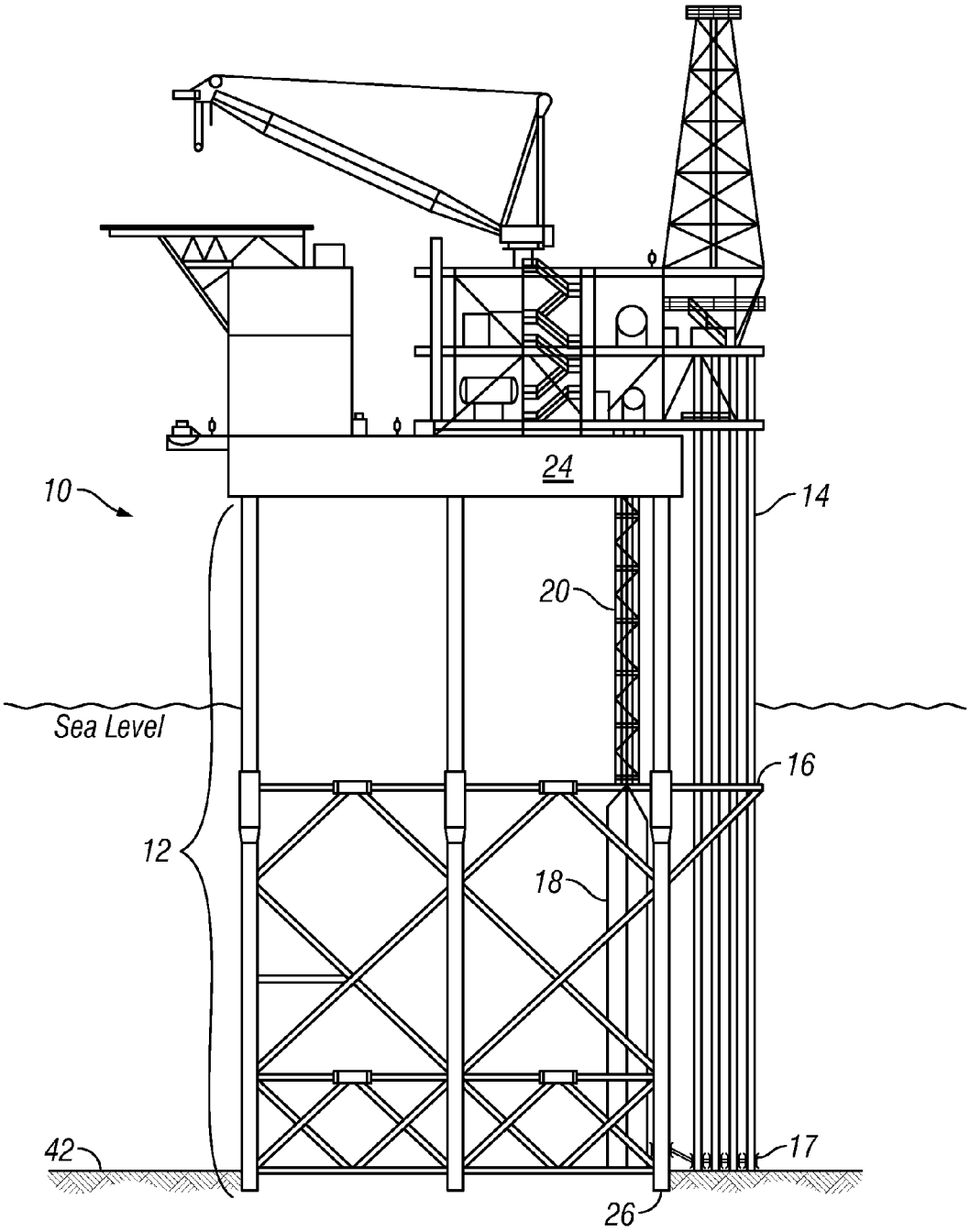
FIG. 1 is an example wellhead platform.

An example bottom supported marine wellhead drilling platform is shown at 10 in FIG. 1, consisting of the topsides (processing) components 24 and the jacket 12 (structural)—which is the entire structure below the topsides 24. The wells are housed within conductors 14. The wells transfer the produced hydrocarbons to the platform. After processing the risers 18, sometimes protected by a riser cage 20, transfer the hydrocarbon to the pipeline. In this example there is a single conductor guide 16, located at 8.8 m below sea level. There can be many conductor guides, depending on the environmental loads, water depth, conductor size, etc. all of which would be disposed between the water bottom 42 and the topsides 24. The conductor guides provide lateral support to the conductors and increase the allowable buckling loads of the conductors. An above mud line whipstock (see FIG. 3) according to the invention provides a system that allows establishing a new wellbore from a platform template location 17 after reclaiming the structural conductor pipe in the following manner. A wellbore conductor guide 16 may form part of the platform 10 structure above the water bottom 42. The platform 10 is generally supported by columns 12 extending from the water bottom 42 to the deck 24.

Figure 2A:
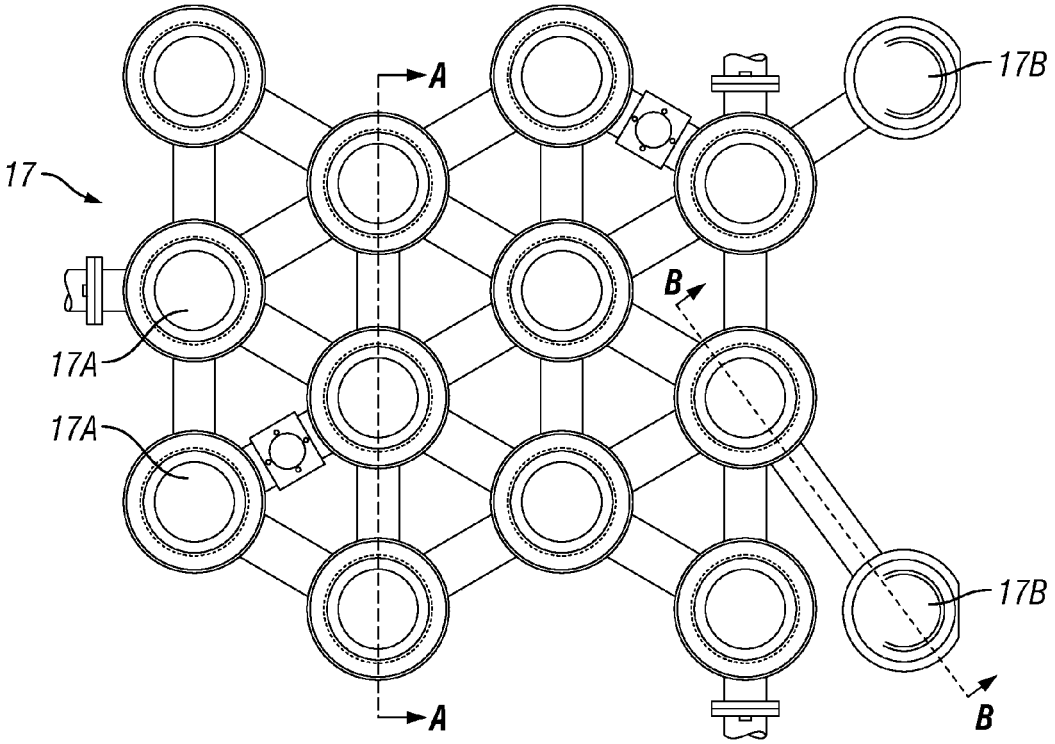
FIGS. 2A and 2B show, respectively a subsea template having slots for wellbores in plan and side view.
Figure 2B:
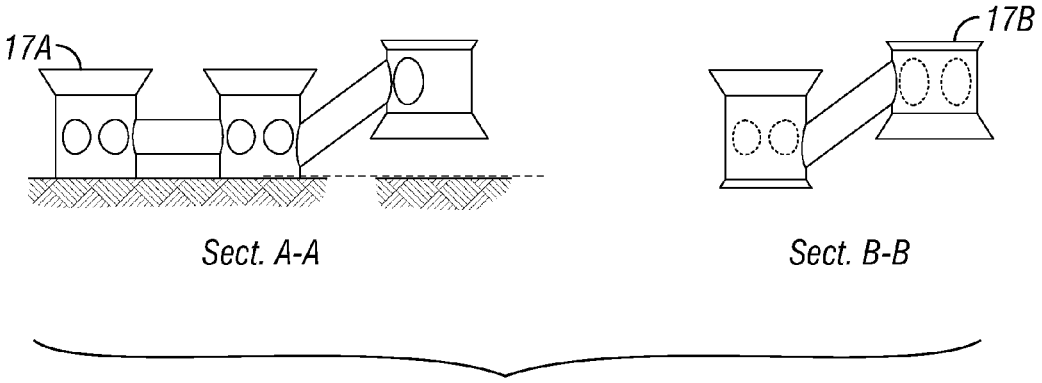

FIGS. 2A and 2B show, respectively a plan view and an elevation view of a typical template 17 used to guide conductor pipe for drilling wellbores. The template 17 is generally disposed on the water bottom (42 in FIG. 1) FIG. 2A shows that some of the openings 17A in the template 17 are used for guiding conductor pipes, and others 17B are used for docking the columns (26 in FIG. 1) that support the platform.

Figure 3:
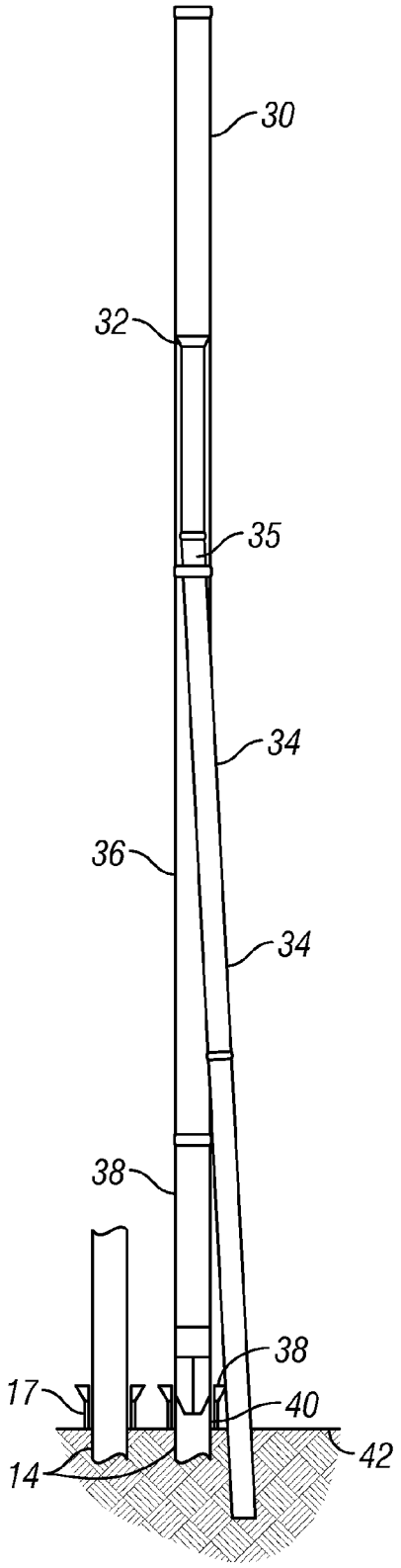
FIG. 3 shows an example above water bottom whipstock according to the invention.

In an example method and system according to the invention, and referring to FIG. 3, a wellbore to be abandoned is secured by abandonment techniques known in the art and is reclaimed up to the conductor pipe 14. The abandonment techniques can be designed to work around problems such as mud line suspension systems and wellbore tiebacks. The conductor pipe 14 is cut and retrieved above the water bottom 42 using the template (see 17 in FIGS. 2A and 2B) as a guide for a new conductor pipe. The exposed cut surface 40 of the conductor pipe 14 is then milled smooth to provide a load bearing surface (i.e., to accept axial loading from the whipstock and drilling operations conducted therethrough.

A new vertical conductor pipe 36 with an integral above seabed mud line whipstock 30 is run, oriented and landed in the cut conductor 14 "stub" proximate the water bottom 42 within the template (17 in FIG. 2A). A stab-in sub 38 is built with gussets (not shown separately) to prevent rotation of the conductor pipe 30 as the new wellbore is established. A side exiting whipstock window 35 is high enough above the template (17 in FIG. 2A) and is below an upper end of the above seabed mudline whipstock 30 to ensure no interference with the template 17 in FIG. 2A).

A selected diameter "scab" liner 34 may then run through the window in the whipstock 30 and set on the water bottom 42. The scab liner 34 does not extend to the water surface, but only to the window 35, and only provides a conduit (acts as a hole-finder) to ensure the newly drilled wellbore section is not lost after drilling prior to running surface casing in the new wellbore. The scab liner 34 may be deployed with a J-latch tool 32 and left in the wellbore. The scab liner 34 allows the conductor pipe 36 to remain vertical, and also helps the whipstock conductor pipe 36 to resist rotation.

Once the whipstock system is deployed as described, the "surface hole" (the portion of the wellbore from the water bottom 42 to the initial or surface casing depth) can be drilled without a riser through the window 36 and scab liner 34 to the selected surface casing depth. Then surface casing (not shown) can be run in the well and cemented in place. A wellhead (not shown) may be installed on the top of the surface casing (not shown) and drilling operations can proceed as would be done ordinarily on a new wellbore. Alternatively, a riser may be installed on top of the surface casing to extent the wellbore to the topsides (24 in FIG. 1).

Possible advantages of the above mud line whipstock may include that it is designed to enable avoiding reclaiming any existing mud line suspension from the abandoned wellbore as well as any tieback systems. New conductor pipe lands on the cut conductor pipe. The cut conductor pipe can still provide structural load bearing support.

Whipstock placement ensures that the scab liner 34 will not interfere with any of the water bottom template (17 in FIG. 2A) guides. The system does not impart any side loads on the platform (10 in FIG. 1). Such feature becomes increasingly important in shallower water wherein typical platform structures do not have the same structural strength as platforms intended for deeper water.

The system is re-usable. For the next slot reclamation it is only necessary to cut and pull the surface casing, isolate with cement, retrieve the scab liner 34 with the J-latch running tool 32, engage the cut off conductor pipe 14 as before, lift and re-orient the whipstock conductor pipe 36, set it down on the cut conductor pipe stub, re-run the scab liner 34 and repeat the above described process. On subsequent reclamations the foregoing process should save several days of rig time per reclamation.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for drilling a wellbore from a water bottom supported platform having wellbores with conductor pipes disposed through guide slots in a template on the bottom of a body of water, the method comprising:

abandoning a selected wellbore and reclaiming all equipment to the top of the wellbore conductor pipe;

cutting the conductor pipe proximate the water bottom;

inserting a whipstock system into the cut conductor pipe, the whipstock system including a whipstock pipe configured to engage the top of the cut conductor pipe, the whipstock pipe extending from the cut conductor pipe to an upper end of the whipstock system, a side exiting window in the whipstock pipe disposed above the water bottom and below the upper end of the whipstock pipe, the whipstock system comprising a scab liner extending through the side exiting window in the whipstock pipe;

extending the scab liner from through the window to the water bottom; and drilling a wellbore to a selected depth through the scab liner.

2. The method of claim 1 further comprising retrieving the scab liner and whipstock pipe and repeating the abandoning, cutting, inserting the whipstock system and drilling on a different wellbore having a conductor pipe extending through a guide slot in the template.

3. The method of claim 1 wherein prior to engaging the whipstock pipe onto the cut conductor pipe, an exposed cut surface of the conductor pipe is milled to provide a smooth surface.

4. The method of claim 1 wherein the selected depth is a depth to which a surface casing is to be installed in the drilled wellbore.

5. The method of claim 1 wherein the cut conductor pipe provides axial support to the whipstock system.

6. The method of claim 1 wherein the whipstock system applies substantially no side loading to the platform.

7. The method of claim 1 further comprising, after drilling the wellbore to the selected depth, removing the scab liner, and repeating the abandoning, cutting, inserting the whipstock system and drilling a wellbore on a different conductor pipe disposed through a different guide slot.

* * * * *